US007135446B1

(12) United States Patent
Schouest et al.

(10) Patent No.: US 7,135,446 B1
(45) Date of Patent: Nov. 14, 2006

(54) SYSTEM FOR CLEANING AND PROTECTING WINDSHIELDS

(75) Inventors: Bryan Schouest, Metairie, LA (US); Harrison M. Weber, Baton Rouge, LA (US)

(73) Assignee: Diamondite, L.L.C., New Orleans, LA (US)

( * ) Notice: Subject to any disclaimer, the term of this patent is extended or adjusted under 35 U.S.C. 154(b) by 108 days.

(21) Appl. No.: 10/353,852

(22) Filed: Jan. 28, 2003

Related U.S. Application Data

(60) Provisional application No. 60/352,435, filed on Jan. 28, 2002.

(51) Int. Cl.
*C11D 3/12* (2006.01)
*C11D 7/16* (2006.01)
*C11D 7/20* (2006.01)

(52) U.S. Cl. ..... 510/180; 510/181; 510/406; 510/507; 510/509; 510/510

(58) Field of Classification Search ..... 510/180, 510/181, 406, 507, 509, 510
See application file for complete search history.

(56) References Cited

U.S. PATENT DOCUMENTS

| | | | | | |
|---|---|---|---|---|---|
| 3,928,065 | A | * | 12/1975 | Savino | 134/7 |
| 4,002,571 | A | * | 1/1977 | Anderle et al. | 510/406 |
| 4,051,056 | A | * | 9/1977 | Hartman | 510/369 |
| 4,338,377 | A | | 7/1982 | Beck et al. | |
| 4,394,179 | A | * | 7/1983 | Ellis et al. | 134/7 |
| 4,395,456 | A | | 7/1983 | Jackson et al. | |
| 4,436,637 | A | * | 3/1984 | Ramachandran et al. | 510/328 |
| 4,450,151 | A | | 5/1984 | Shinozawa | |
| 4,687,591 | A | | 8/1987 | Castaldo | |
| 4,830,783 | A | * | 5/1989 | Ellis et al. | 510/113 |
| 4,877,691 | A | * | 10/1989 | Cockrell, Jr. | 428/688 |
| 5,034,114 | A | | 7/1991 | Kukin | |
| 5,076,952 | A | | 12/1991 | Ahmed et al. | |
| 5,128,027 | A | | 7/1992 | Halaka et al. | |
| 5,364,551 | A | * | 11/1994 | Lentsch et al. | 510/100 |
| 5,712,355 | A | | 1/1998 | Jones | |
| 5,779,912 | A | | 7/1998 | Gonzalez-Martin et al. | |
| 5,846,650 | A | | 12/1998 | Ko et al. | |
| 5,872,111 | A | | 2/1999 | Au et al. | |
| 5,928,064 | A | | 7/1999 | Miller | |
| 5,969,067 | A | | 10/1999 | Brothers et al. | |
| 5,981,459 | A | * | 11/1999 | Verbiest et al. | 510/279 |
| 6,156,389 | A | | 12/2000 | Brown et al. | |
| 6,177,196 | B1 | | 1/2001 | Brothers et al. | |
| 6,183,872 | B1 | | 2/2001 | Tanaka et al. | |
| 6,207,780 | B1 | | 3/2001 | Stockhausen et al. | |
| 6,241,579 | B1 | | 6/2001 | Miller, III et al. | |
| 6,310,014 | B1 | | 10/2001 | Rau | |
| 2003/0027737 | A1 | * | 2/2003 | Evers | 510/357 |

FOREIGN PATENT DOCUMENTS

| | | | |
|---|---|---|---|
| CN | 1050559 A | * | 4/1991 |
| EP | 0103466 A1 | * | 3/1984 |

* cited by examiner

*Primary Examiner*—Lorna M. Douyon
(74) *Attorney, Agent, or Firm*—Garvey, Smith, Nehrbass & North, L.L.C.; Seth M. Nehrbass; Brett A. North

(57) ABSTRACT

A system for cleaning acid rain marks from automobile glass includes powdered kaolin clay in a spray can. The automobile glass is preferably cleaned with this system, then a system for more effectively delivering Fibershield 218 and like protectants to glass is used to add a protectant to the windshield.

9 Claims, No Drawings

SYSTEM FOR CLEANING AND PROTECTING WINDSHIELDS

CROSS-REFERENCE TO RELATED APPLICATIONS

Priority of our U.S. Provisional patent application Ser. No. 60/352,435, filed 28 Jan. 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to automobile windshields. More particularly, the present invention relates to cleaning and protecting automobile windshields.

2. General Background of the Invention

Acid rain causes spots on automobile windows and windshields which are difficult to remove. One commercially available method of removing these spots involves rubbing the glass with a piece of clay (see, for example, products sold under the trademark CLAY-MAGIC, U.S. Trademark Registration No. 1,890,761). However, this is a difficult job, is typically only done professionally, and is not in widespread use.

Glass and glass windshields get contaminated with acid rain spots and by mineral deposit from the rain. These contaminants are mostly impossible to remove, except by fairly drastic professional treatment. This often involves grinding away the deposits with a machine buffer utilizing abrasive compound. This not a job for the "do-it-yourselfer". It is very easy to permanently scratch the glass, ruining the windshield.

It is known in the automotive aftermarket trade that kaolin clay can remove mineral deposits from painted automotive surfaces if properly applied. This involves dragging a solid block of clay across the paint using a soapy water solution as a lubricant. This prevents scratching and prevents drag. However, the process is somewhat difficult and requires a higher skill level. If the bar is not rotated frequently, the accumulated contaminant will quickly scratch the finish. It is a process that does not lend itself to glass. Kaolin clay by itself will not scratch the glass since the material is softer. The mineral deposits are, however, much harder.

Kaopolite SF (super fine kaolin clay) has been used for many years in car polishes for painted surfaces.

Fibershield 218, commercially available from Fibershield Industrials, is a coating for aircraft windows to help them repel rain, making it sheet. Fibershield 7525 is a similar coating.

A web site sponsored by PPG tells about their product "Aquapel". It appears to be the same type of chemistry as Fibershield 218. However, it is applied using a special sponge applicator. The PPG product is for professional use so the inventors believe that it is the standard water-based product that requires buffing clear. Aquapel makes no claims as scratch resistance. They also make no claims about treating acrylics (either Plexiglas or polycarbonate).

The following U.S. patents are incorporated herein by reference: U.S. Pat. Nos. 4,051,056; 4,338,377; 4,395,456; 4,450,151; 4,687,591; 5,034,114; 5,076,952; 5,128,027; 5,712,355; 5,779,912; 5,846,650; 5,872,111; 5,928,064; 5,969,067; 6,156,389; 6,177,196; 6,183,872; 6,207,780; 6,241,579; and 6,310,014.

U.S. Pat. No. 4,687,591 discloses an aerosol cleaning composition with 15–25% by weight kaolin clay for cleaning cymbals.

U.S. Pat. No. 4,450,151 discloses an aerosol composition which could contain 5–60% by weight kaolin clay.

U.S. Pat. No. 5,076,952 discloses a liquid dishwasher cleaning agent which can contain clay particles, sodium bicarbonate and sodium tripolyphosphate.

U.S. Pat. No. 4,395,456 discloses an inorganic foam which can include kaolin clay.

U.S. Pat. No. 5,034,114 discloses neutralizing acid with a solution containing sodium bicarbonate and a detergent tripolyphosphate.

U.S. Pat. No. 6,241,579 discloses a surface polishing applicator system and method. U.S. Pat. No. 5,928,064 discloses a surface polishing method and system. Both of these patents are assigned to Auto Wax Company, Inc., the maker of Clay Magic brand polish and bars containing abrasive material for removing stains from automobiles.

U.S. Pat. No. 5,846,650 discloses a protective coating for windshields (see column 1, line 9) that prevents ice build-up and contains a fluoropolymer and a fluorochemical surfactant (see column 2, lines 35–42).

U.S. Pat. Nos. 5,969,067 and 6,177,196 disclose a coating solution containing a fluoropolymer, which can be applied to a windshield (see column 7, lines 7 and 8).

U.S. Pat. No. 6,156,389 discloses a protective coating that is applied to windshield and contains a fluoropolymer (see claim 3 in Column 32).

U.S. Pat. No. 5,712,355 discloses a formulation that contains fluoropolymers, fluorosurfactants and water that is applied to glass microscope slides as a protectant.

U.S. Pat. No. 6,183,872 discloses a fluoropolymer coating which apparently chemically bonds to glass (see column 3, lines 35–40).

BRIEF SUMMARY OF THE INVENTION

The present invention includes a system for cleaning acid rain marks from automobile glass and a system for more effectively delivering Fibershield 218 and like protectants to glass.

The present invention includes apparatus for cleaning glass having acid rain deposits and/or mineral deposits, preferably comprising:

a foaming clay windshield cleaner comprising:

clay for freeing mineral deposits;

sodium bicarbonate for neutralizing acid rain deposits; and a chelator to keep the deposits from clinging on the glass and re-depositing. The chelator is preferably sodium tripolyphosphate. The cleaner is preferably formulated as a convenient, effective aerosol foam or as a convenient, effective aerosol spray. The clay is preferably kaolin clay. Preferably, synthetic detergent is included to clean away and suspend both mineral deposits and acid rain deposits. Most preferably, the cleaner includes an aerosol foaming propellant.

The present invention includes a method of cleaning glass, comprising spraying the apparatus of the present invention mentioned in the paragraph above on glass;

allowing the cleaner to sit on the glass for 5–15 minutes;

rubbing the cleaner off with a soft cloth.

The present invention includes a system for more effectively delivering Fibershield 7525 and like protectants to glass comprising a concentrate comprising:

80–90% by weight water;

5–15% by weight fluoropolymer. The concentrate preferably further comprises about 1.0–20 by weight wetting agent. The system can comprise about 80% by weight of the concentrate and about 20% by weight of a propellant.

The present invention includes a system for more effectively delivering Fibershield 218 and like protectants to glass comprising a concentrate comprising:

60–90% by weight alcohol;

5–15% by weight fluoropolymer;

5–10% by weight acetone; and

20–30% by weight aerosol propellant. The alcohol can comprise isopropyl alcohol, propanol, acetone/ketone, and/or ethanol (specially denatured or fully denatured).

The present invention includes a kit for cleaning and protecting glass, comprising:

a spray clay;

a glass and surface cleaner;

a fluoropolymer delivery agent. Preferably, the spray clay comprises a foaming clay windshield cleaner comprising:

clay for freeing mineral deposits;

sodium bicarbonate for neutralizing acid rain deposits; and a chelator to keep the deposits from clinging on the glass and re-depositing; and the fluoropolymer delivery agent comprises:

60–90% by weight alcohol;

5–15% by weight fluoropolymer;

5–10% by weight acetone; and

20–30% by weight aerosol propellant. Preferably, the glass and surface cleaner comprises:

a chelator, a diluent, a solvent, a surfactant, a pH builder, and a propellant.

DETAILED DESCRIPTION OF THE INVENTION

The cleaning system comprises a clay-based formula including the kaolin clay presently used for this purpose in bar form, but in powder form mixed with lubricants, other cleaners, and delivery agents. This formula is preferably delivered to glass by spraying, using an aerosol foaming propellant.

Before applying the glass treatment system of the present invention, it is desirable to have a clean, uncontaminated glass surface prior to treatment for the polymer to achieve maximum effectiveness. The foaming clay windshield cleaner of the present invention incorporates kaolin clay, combined with sodium bicarbonate and synthetic detergent to clean away and suspend both mineral deposits and acid rain contaminant on glass. The sodium bicarbonate neutralizes the acid rain deposit. Chelators (such as sodium tripolyphosphate) keep the deposits from clinging on the glass and re-depositing. The clay frees the mineral deposit. These three things are believed to be the most important ingredients. Additionally, the product is formulated as a convenient, effective aerosol foam or spray.

The device of the present invention safely and easily removes mineral deposits and acid rain contaminant from glass and auto windshields. It is a mechanism that incorporates chemical and mechanical action. It differs from commercial buffing in that the procedure and device can be applied by the user without special training, machinery or skills. The device is an easy-to-use unique inverted aerosol foam that clings to the glass prior to treatment and facilitates clean clay with every application. This is not a clay bar and the present invention pertains only to glass. It does not pertain to painted or other surfaces (several commercially available cleaners/waxes for paint include clay). This is a chemical/mechanical glass cleaner designed to specifically remove mineral and acid rain deposits. And, unlike the clay bar, this is a one-step process.

Preferred Formula:

| Chemical | Function | Percentage by Weight |
|---|---|---|
| Water (preferably deionized water or distilled water, though one could use tap water if an aluminum container is used) | Diluent | Preferably about 30–70<br>More preferably about 60–70<br>Most Preferably about 62–66<br>About 65.34, for example |
| Sodium Benzoate | Can preservative (optional, could be omitted, and more water could be used) | Preferably about 1.0–0.10<br>More preferably about 0.80–0.10<br>Most Preferably about 0.70–0.10<br>About 0.20, for example |
| A water soluble phosphate, or nitrilo acetic acid (NTA)), preferably Sodium Tripolyphosphate | Chelator | Preferably about 2.0–0.10<br>More preferably about 1.5–0.25<br>Most Preferably about 1.0–0.40<br>About 0.504, for example |
| Dehydrated Clay, preferably Dehydrated Kaolin Clay | Cleans mineral deposits | Preferably about 25–5.0<br>More preferably about 15–6<br>Most Preferably about 12–7<br>About 10, for example |
| Neutralizer, preferably sodium bicarbonate (but calcium carbonate, for example, could be used also) | Cleans acid deposits | Preferably about 10–0.6<br>More preferably about 9–0.7<br>Most Preferably about 7–1.0<br>About 1.0, for example |
| Synthetic (non-ionic) detergent | Emulsifier and cleaner | Preferably about 10–0.20<br>More preferably about 7–0.4<br>Most Preferably about 6–0.5 |

-continued

| Preferred Formula: | | |
|---|---|---|
| Chemical | Function | Percentage by Weight |
| | | About 1.998, for example |
| Solvent, such as soy bean ester, hydrocarbon solvent (napthenic or paraffinic, glycol ether, vegetable oil, alcohols or any solvent with a KB (Kauri Butanol value) low enough to not damage the glass but high enough to add cleaning power). | Solvent degreaser | Preferably about 30–5.0<br>More preferably about 20–7<br>Most Preferably about 15–8<br>About 9.990, for example |
| Oil, preferably silicone oil | Lubricant, brightener | Preferably about 5–0.10<br>More preferably about 3–0.10<br>Most Preferably about 2–0.20<br>About 1.95, for example |
| Hydrocarbon propellant or, e.g., $CO_2$, Dimethyl ether, 143A or 152A | Aerosol foaming propellant | Preferably about 15–4.0<br>More preferably about 13–5<br>Most Preferably about 12–7<br>About 10, for example |

The clay-based cleaning product of the present invention is preferably primarily packaged as an inverted whipped cream-like foam (preferably with a valve typically used on whipped cream containers) but can also be sprayed upright with a clog-resistant valve. This product can also be sprayed as a solvent-based aerosol. It could be sprayed on like touch-up paint or it can be packaged as a thick liquid squirted through a flip-top lid. Additionally, it can be applied as a cream or thicker paste. The essence is a clay/sodium bicarbonate glass cleaner designed to clean away mineral and acid deposits on glass. The glass could be wiped immediately, or the cleaner could be allowed to sit on the glass for 5–15 minutes; the glass is then buffed with a soft cloth for about 10 seconds–10 minutes to remove the stains. The stains are removed through a chemical process in which the formula reacts with the stains to cause them to not adhere any more to the glass.

It is likely that Aerosol Specialties and others use and will use this clay in other conventional, paint-type polishes but never for glass. This use to decontaminate glass is proprietary to and developed by the present inventors.

The present inventors have invented a system for more effectively delivering Fibershield 218 and like protectants to glass. They have developed two formulations, one water-based and the other IPA (isopropyl alcohol) based.

The system of the present invention for more effectively delivering Fibershield 218 and like protectants to glass preferably sprays on. It is also a fast drying alcohol based system. The alcohol also improves the wetting action. The system of the present invention is designed for the "do it yourselfer".

The formulas are as follows:

| Water based: | | |
|---|---|---|
| Chemical | Function | Percentage by Weight |
| Water | diluent | Preferably about 60–98<br>More preferably about 65–96<br>Most Preferably about 80–95<br>90, for example |
| fluoropolymer (such as Fibershield 218, but | | Preferably about 5–15<br>More preferably about 6–14 |

-continued

| Water based: | | |
|---|---|---|
| Chemical | Function | Percentage by Weight |
| preferably Fibershield 7525) | | Most Preferably about 7–13<br>10.00, for example |
| Polar solvent (such as an alcohol, a ketone, or a glycol ether) | wetting agent (optional) | Preferably about 1.0–20<br>More preferably about 4–15<br>Most Preferably about 5–10<br>About 5, for example |

If used in a pump, the water-based formula is preferably used as is. If used in an aerosol, one could use, e.g., 80% of the water-based formula and 20% of a propellant, such as aerosol propellant A/46 (a propane/isobutane blend). In either event, a fluorosurfactant (DuPont ISP 100 or equivalent) or a 9–13 mole nonylphenyl surfactant could be used, in an amount of about 0.005 percent by weight. However, preferably no fluorosurfactant is used.

| IPA based (preferred formulation): | | |
|---|---|---|
| Chemical | Function | Percentage by Weight |
| alcohol, preferably isopropyl alcohol or ethanol (specially denatured or fully denatured), but propanol and acetone/ketone (and combinations of all of these) could also be used | diluent | Preferably about 60–90<br>More preferably about 61–80<br>Most Preferably about 63–70<br>About 63.9, for example |
| fluoropolymer (preferably Fibershield 218) | Protectant | Preferably about 5–15<br>More preferably about 6–14<br>Most Preferably about 6.5–12<br>About 8.0, for example |
| A polar solvent, preferably acetone | to increase solubility | Preferably about 5–30<br>More preferably about 5–10<br>Most Preferably about 6–9<br>About 8.0, for example |
| aerosol propellant A/46 (or nitrous oxide or dimethyl ether or $CO_2$ or nitrogen) | propellant | Preferably about 14–30<br>More preferably about 15–28<br>Most Preferably about 16–25<br>20.0, for example |

The IPA based formula could use other alcohols, such as propanol, acetone/ketone, and/or ethanol (specially denatured or fully denatured).

Fibershield 218 uses hydrogen bonding to bond to the glass; it polymerizes in about 24 hours, providing a thin film which protects the glass. This thin film lasts several weeks at least, and perhaps even several months. Additional coatings can be applied over earlier coatings.

The method and coating system of the present invention can be used on ceramic tiles and stone containing silicon dioxide (e.g., granite, marble) as well as glass.

The glass and surface cleaner of the present invention was specifically designed to work with the entire system of the present invention. This powerful cleaner has been supercharged with special detergents (sodium bicarbonate and non-ionic surfactant) that target the embedded deposits in the grooves of glass and glass-like surfaces. The glass and surface cleaner of the present invention helps users prepare their surface before the application of the spray clay of the present invention and also helps remove the residual clay residue before the shield product of the present invention is applied.

The foaming action of the glass and surface cleaner of the present invention lets users know it is working and does wipe away clean with no streaks.

To get the best out of the entire system of the present invention, the glass and surface cleaner of the present invention is used.

Preferred Glass and Surface Cleaner Formulation

| Chemical | Function | Percentage by Weight |
|---|---|---|
| A water soluble phosphate, or nitrilo acetic acid (NTA)), preferably Sodium Tripolyphosphate | chelator | Preferably about 0.1–2<br>More preferably about 0.2–1.5<br>Most Preferably about 0.3–0.8<br>About 0.5, for example |
| Water | diluent | Preferably about 90–50<br>More preferably about 85–60<br>Most Preferably about 85–70<br>About 83.2, for example |
| a chelator, preferably sodium bicarbonate or calcium carbonate | chelator | Preferably about 0.1–2<br>More preferably about 0.2–1.5<br>Most Preferably about 0.3–0.8<br>About 0.5, for example |
| Any ethylene or propylene glycol ether, preferably Butyl Cellosolve ™ brand Ethylene Glycol Mono-n-butyl Ether | solvent | Preferably about .1–5<br>More preferably about .3–3<br>Most Preferably about .4–2<br>About 1, for example |
| Non-ionic surfactant with an HLB (hydrophilic lithophilic balance) of 9–13, nonylphenyl surfactant, 9–13 moles of ethylene oxide | Surfactant | Preferably about 1–.05<br>More preferably about .7–.09<br>Most Preferably about .6–.2<br>About .3, for example |
| Solvent, preferably Methylal [Dimethyl Formal] | Solvent | Preferably about 5–.1<br>More preferably about 4–.3<br>Most Preferably about 3–.5<br>About 1, for example |
| Alcohols or ketones, preferably ethanol or Isopropyl Alcohol (IPA) (or combinations of all of these) | solvent | Preferably about 15–.3<br>More preferably about 10–.5<br>Most Preferably about 8–.9<br>About 7, for example |
| Aqueous ammonia (or any ammonia bearing amine) | pH Builder | Preferably about .05–1<br>More preferably about .06–.9<br>Most Preferably about .07–.8<br>About 0.2, for example |

-continued

Preferred Glass and Surface Cleaner Formulation

| Chemical | Function | Percentage by Weight |
|---|---|---|
| Hydrocarbon Propellant A-46 (or nitrous oxide or dimethyl ether or $CO_2$ or nitrogen) | Propellant | Preferably about .2–12<br>More preferably about .5–10<br>Most Preferably about .7–9<br>About 6, for example |

The present invention includes a kit including a spray clay (preferably the preferred spray clay of the present invention), a glass and surface cleaner (preferably the preferred glass and surface cleaner of the present invention), and a fluoropolymer delivery agent (preferably the preferred IPA-based formula of the present invention including Fibershield 218).

More information about the present invention can be found at www.diamondite.com.

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. Composition for cleaning glass having acid rain deposits and/or mineral deposits, comprising:

a clay windshield cleaner comprising:

kaolin clay for freeing mineral deposits, wherein the amount of clay ranges between about 5 and 25 weight percent;

solvent comprising soy bean ester, wherein the amount of solvent ranges from about 5.0 to about 30 weight percent;

sodium bicarbonate for neutralizing acid rain deposits; and a chelator to keep the deposits from clinging on the glass and re-depositing; wherein the amount of chelator ranges from about 0.10 to about 2.0 weight percent; and wherein the cleaner is formulated as a convenient, effective aerosol foam or aerosol spray.

2. The composition of claim 1, wherein the chelator is sodium tripolyphosphate.

3. The composition of claim 1, wherein the cleaner is formulated as a convenient, effective aerosol foam.

4. The composition of claim 1, wherein the cleaner is formulated as a convenient, effective aerosol spray.

5. The composition of claim 1, further comprising synthetic detergent to clean away and suspend both mineral deposits and acid rain deposits.

6. The composition of claim 1, wherein the cleaner includes an aerosol foaming propellant.

7. The composition of claim 1, wherein the amount of clay ranges between about 6 and 15 weight percent.

8. The composition of claim 1, wherein the amount of clay ranges between about 7 and 12 weight percent.

9. The composition of claim 1, wherein the amount of clay is about 10 weight percent.

* * * * *